US007734056B2

(12) United States Patent
Ohara

(10) Patent No.: US 7,734,056 B2
(45) Date of Patent: Jun. 8, 2010

(54) DAMPER STRUCTURE OF PREVENTING IRREGULAR VIBRATION FOR SPEAKER

(76) Inventor: Hiroshi Ohara, No. 70, Lane 533, Chong-Fong Road, U-Lin Village, Long-Tan County, Taou-Yuan Hsien (TW)

( * ) Notice: Subject to any disclaimer, the term of this patent is extended or adjusted under 35 U.S.C. 154(b) by 1129 days.

(21) Appl. No.: 11/325,438

(22) Filed: Jan. 5, 2006

(65) Prior Publication Data

US 2007/0154059 A1 Jul. 5, 2007

(51) Int. Cl.
*H04R 25/00* (2006.01)

(52) U.S. Cl. ..... 381/413; 381/396

(58) Field of Classification Search ..... 381/202, 381/396–398, 432–433, 403, 404, 413; 181/166–170, 181/171–174

See application file for complete search history.

(56) References Cited

U.S. PATENT DOCUMENTS 5,757,945 A * 5/1998 Sakamoto ..... 381/400
6,343,136 B2 * 1/2002 Tokusho et al. ..... 381/398

* cited by examiner

*Primary Examiner*—Tuan D Nguyen
(74) *Attorney, Agent, or Firm*—Birch, Stewart, Kolasch & Birch, LLP

(57) ABSTRACT

A damper structure for a speaker is provided to preventing irregular vibrations, and the improvements comprises the damper having one or more elastic reinforcing pieces attached with a corrugated surface of the damper. The reinforcing pieces may be of smaller annular strips, larger annular strips, or straight strips corresponding to and attached to the corrugated surface of the damper in its inner region, outer region, and in its radial direction and preferably in equiangular distribution, respectively, to strengthen its structural strength and uniformity.

8 Claims, 9 Drawing Sheets

DAMPER STRUCTURE OF PREVENTING IRREGULAR VIBRATION FOR SPEAKER

BACKGROUND OF THE INVENTION

1. Field of the Invention

The present invention relates to a suspension element of a speaker.

2. The Prior Arts

Referring to FIG. 9, a typical dynamic speaker includes a power system, a cone paper (E) and a suspension system, wherein the power system has a magnet (A), an iron bar (B), a gap (C) and a voice coil (D); the cone paper (E) is a diaphragm, which generally forms a conical or semi-spherical voice cavity for vibrating or moving air; and the suspension system is composed of a damper (F) and a suspension ring (G) for limiting movement of the cone paper (E) in a specific direction.

As for the principle of speaker, when the voice coil (D) is loaded by AC current, the current-carrying voice coil (D) in a magnetic field of the magnet (A) experiences a magnetic force and moves up and down in the gap (C), so that the cone paper (E) attached to the voice coil (D) moves air to produce sound.

Other kinds of speakers may have different structures, however, their principles are the same and at least they include a damper.

In view the damper is used for suspending the voice coil and the cone paper, it is generally designed to have a plurality of concentric circular peaks and valleys. That means it has a corrugated structure, which makes the damper have an elastic function like a spring and can support the voice coil and the cone paper. Therefore, the elasticity and strength of the damper will directly affect the strength and amplitude of the cone paper and further affect its sound effect.

A damper is generally made of cloth, which is dipped in resin, dried and formed by a mold. In view the cloth is woven with threads, the damper may have a non-uniform structural strength due to its non-uniform thread density, thereby causing an irregular vibration and affecting its sound quality.

Thus, it is desired to provide an improved damper to solve the above-mentioned problems.

SUMMARY OF THE INVENTION

An objective of the present invention is to provide a damper structure for a speaker, which can prevent irregular vibration and improve its sound quality.

To achieve the above-mentioned objective, an improved damper structure for a speaker in accordance with the present invention is to attach a reinforcing piece to a corrugated surface of the damper for strengthening and balancing its structure, thereby being able to prevent irregular vibration of the damper. The reinforcing piece, which may be of an annular strip or a straight strip, has a corrugated surface for matching with the corrugated surface of the damper in their attachment.

According to a first aspect of the present invention, the reinforcing piece is designed to be of an annular strip and attached to a surface of the damper near its inner region to strengthen its structure.

According to a second aspect of the present invention, the reinforcing piece is designed to be of an annular strip and attached to a surface of the damper near its outer region to strengthen its structure.

According to a third aspect of the present invention, the reinforcing piece is designed to be of a straight strip, and a plurality of reinforcing pieces are attached to a surface of the damper in its radial direction and preferably in equiangular distribution to strengthen its structure.

According to a fourth aspect of the present invention, a larger annular reinforcing piece and a smaller reinforcing piece are attached to a surface of the damper near its outer and inner regions, respectively, to strengthen its structure. And, a plurality of straight reinforcing pieces are attached to the surface of the damper in its radial direction and preferably in equiangular distribution to further strengthen the damper structure.

According to a fifth aspect of the present invention, the reinforcing piece is made from cloth, plastics, rubber or silicon gel. In the case of cloth, the woven direction of the reinforcing piece must be different from that of the damper to obtain a better structural strength of the damper.

In view that the reinforcing piece is to be attached to the damper by adhesive, in manufacturing, it is feasible to put them together into a mold to shape a strengthened damper, thereby simplifying its manufacturing process.

The present invention will become more obvious from the following description when taken in connection with the accompanying drawings, which show, for purposes of illustration only, preferred embodiments in accordance with the present invention. In the drawings:

DETAILED DESCRIPTION OF THE PREFERRED EMBODIMENT

Figure 1:
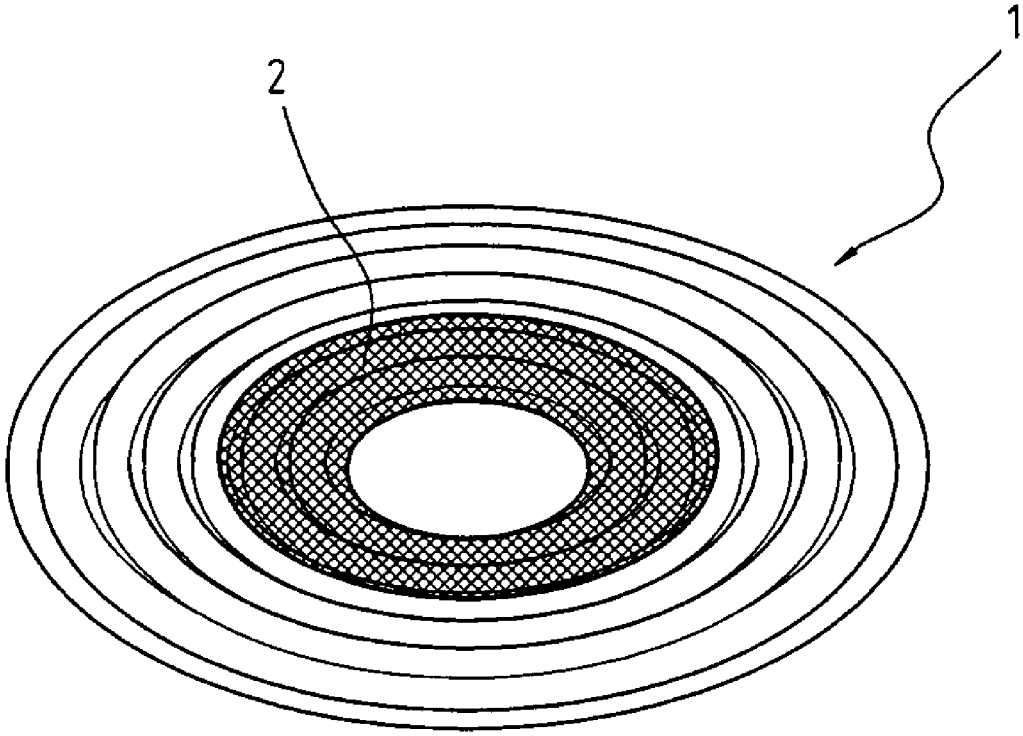
FIG. 1 is a perspective view of a damper in accordance with a first embodiment of the present invention, showing that an annular reinforcing piece is attached to a surface of the damper near its inner region.

Referring to FIG. 1, a damper 1 in accordance with a first embodiment of the present invention has a corrugated surface, and an annular reinforcing piece 2 is attached to the surface of the damper 1 near its inner region. The annular reinforcing piece 2 has a corrugated surface matching with the corrugated surface of the damper 1, thereby obtaining a tight attachment of the reinforcing piece 2 with the damper 1.

Figure 2:
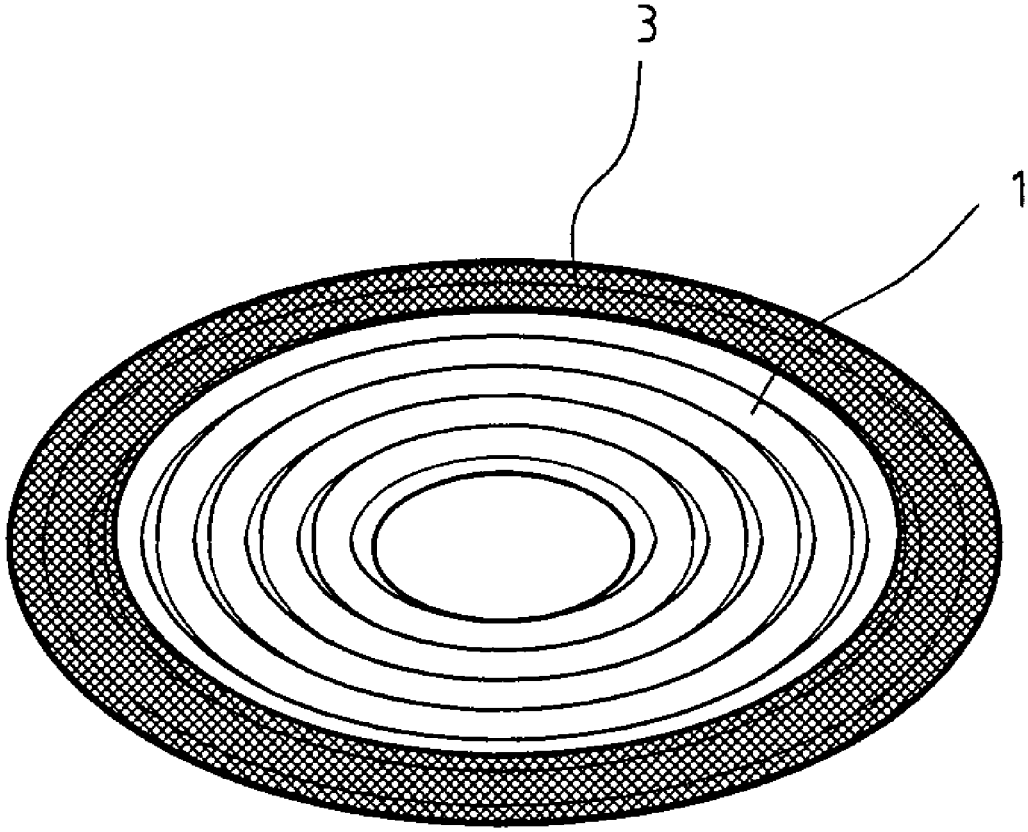
FIG. 2 is a perspective view of a damper in accordance with a second embodiment of the present invention, showing that an annular reinforcing piece is attached to a surface of the damper near its outer region.

Referring to FIG. 2, a damper 1 in accordance with a second embodiment of the present invention has a corrugated surface, and an annular reinforcing piece 3 is attached to the surface of the damper 1 near its outer region. The annular reinforcing piece 3 has a corrugated surface matching with the corrugated surface of the damper 1, thereby obtaining a tight attachment of the reinforcing piece 3 with the damper 1.

Figure 3:
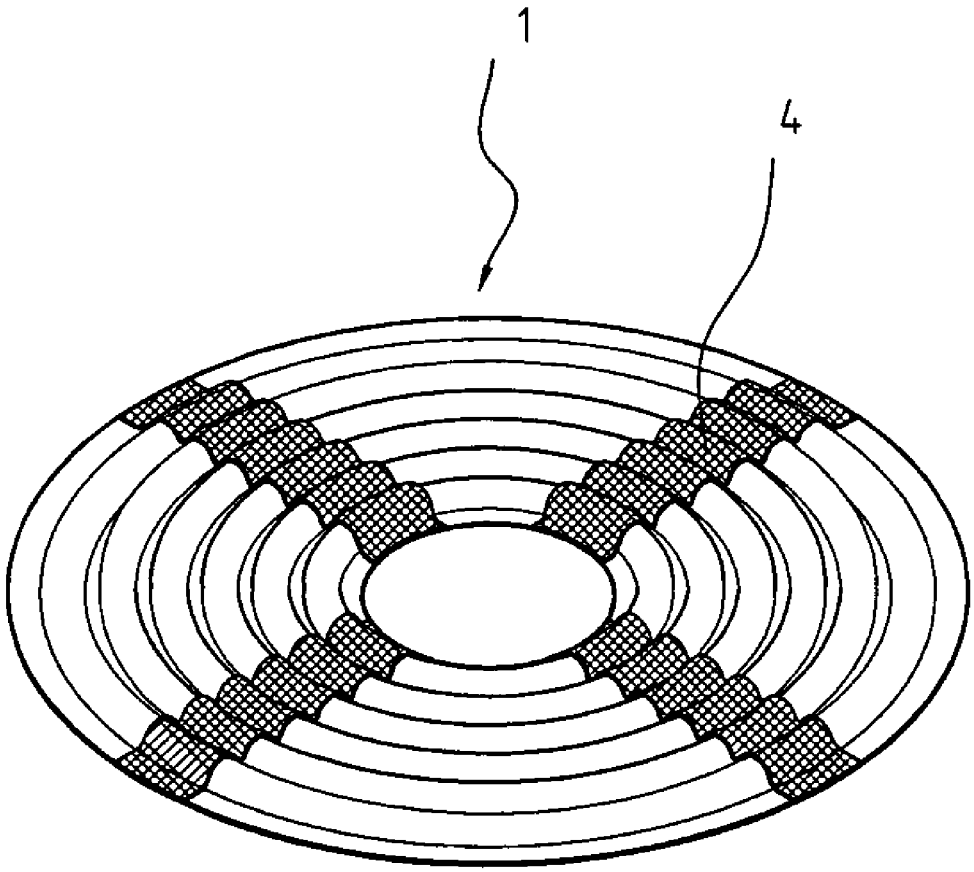
FIG. 3 is a perspective view of a damper in accordance with a third embodiment of the present invention, showing that a plurality of straight reinforcing pieces are attached to a surface of the damper in its radial direction and preferably in equiangular distribution.

Referring to FIG. 3, a damper 1 in accordance with a third embodiment of the present invention has a corrugated surface, and a plurality of straight reinforcing pieces 4 are attached to the surface of the damper 1 in its radial direction and preferably in equiangular distribution. The straight reinforcing pieces 4 have a corrugated surface matching with the corrugated surface of the damper 1, thereby obtaining a tight attachment of the reinforcing pieces 4 with the damper 1.

Figure 4:
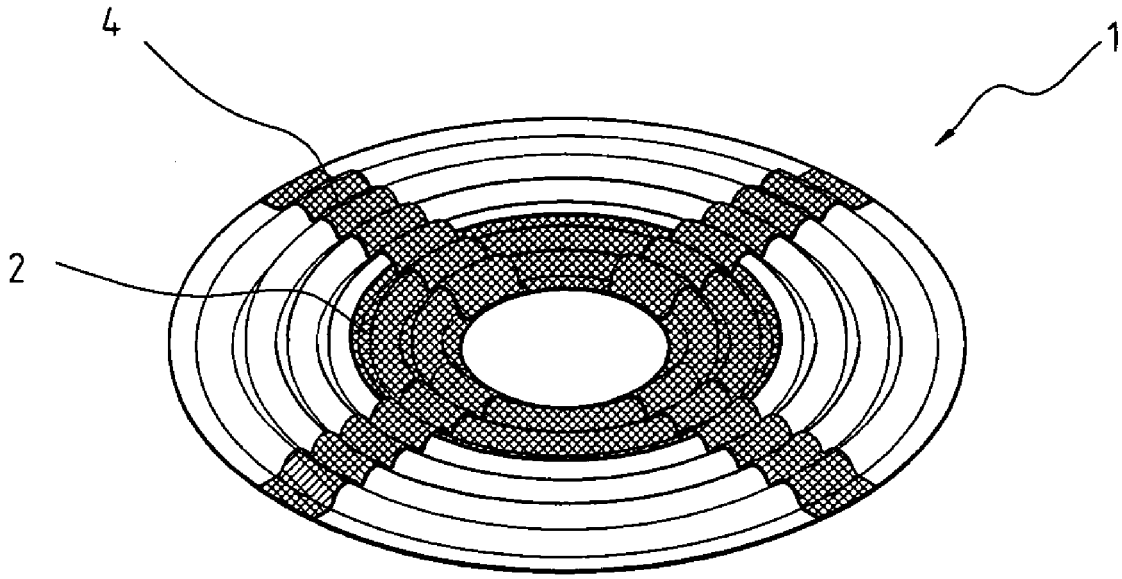
FIG. 4 is a perspective view of a damper in accordance with a fourth embodiment of the present invention, showing that an annular reinforcing piece is attached to a surface of the damper near its inner region and a plurality of straight reinforcing pieces are attached to the surface of the damper in its radial direction and preferably in equiangular distribution.

Referring to FIG. 4, a damper 1 in accordance with a fourth embodiment of the present invention has a corrugated surface, and an annular reinforcing piece 2 are attached to the surface of the damper 1 in its inner region. And a plurality of straight reinforcing pieces 4 are attached to the surface of the damper 1 in its radial direction and preferably in equiangular distribution. The annular reinforcing piece 2 and the straight reinforcing pieces 4 have a corrugated surface matching with the corrugated surface of the damper 1, thereby obtaining their tight attachment with each other.

Figure 5:
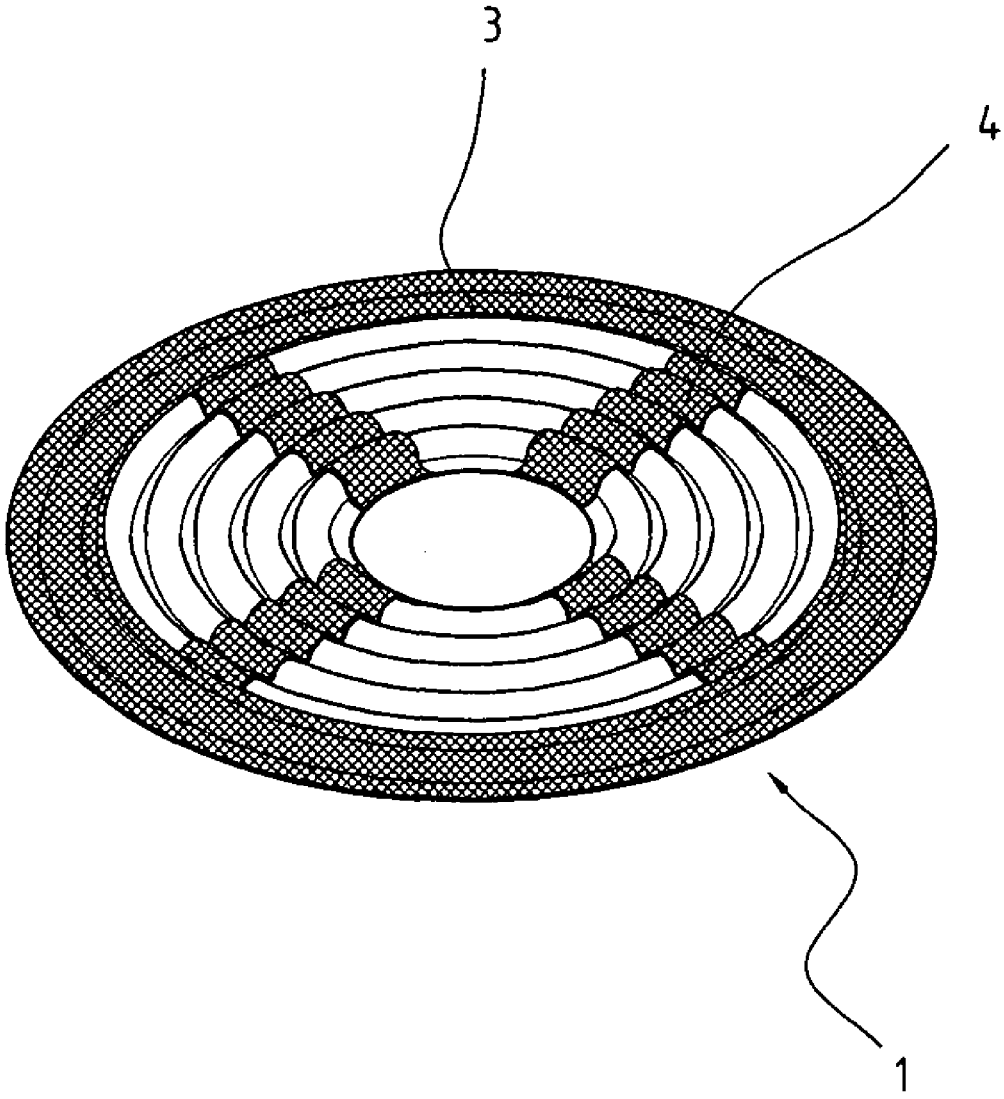
FIG. 5 is a perspective view of a damper in accordance with a fifth embodiment of the present invention, showing that an annular reinforcing piece is attached to a surface of the damper near its outer region and a plurality of straight reinforcing pieces are attached to the surface of the damper in its radial direction and preferably in equiangular distribution.

Referring to FIG. 5, a damper 1 in accordance with a fifth embodiment of the present invention has a corrugated surface, and an annular reinforcing piece 3 are attached to the surface of the damper 1 in its outer region. And a plurality of straight reinforcing pieces 4 are attached to the surface of the damper 1 in its radial direction and preferably in equiangular distribution. The annular reinforcing piece 3 and the straight reinforcing pieces 4 have a corrugated surface matching with the corrugated surface of the damper 1, thereby obtaining their tight attachment with each other.

Figure 6:
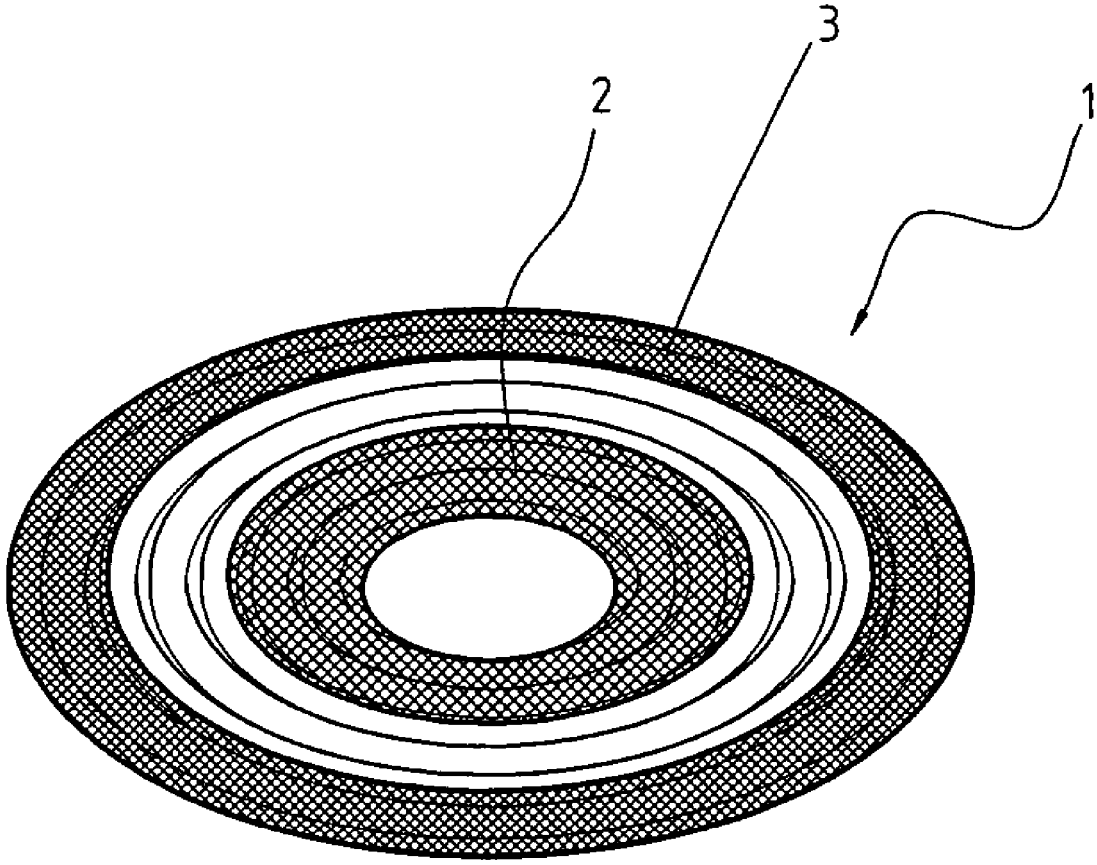
FIG. 6 is a perspective view of a damper in accordance with a sixth embodiment of the present invention, showing that a smaller annular reinforcing piece and a larger annular reinforcing piece are attached to a surface of the damper near its inner and outer regions, respectively.

Referring to FIG. 6, a damper 1 in accordance with a sixth embodiment of the present invention has a corrugated surface, and an smaller annular reinforcing piece 2 and a larger annular reinforcing piece 3 are attached to the surface of the damper 1 near its inner and outer regions, respectively. The two annular reinforcing pieces 2, 3 have a corrugated surface matching with the corrugated surface of the damper 1, thereby obtaining a tight attachment of the two reinforcing pieces 2, 3 with the damper 1.

Figure 7:
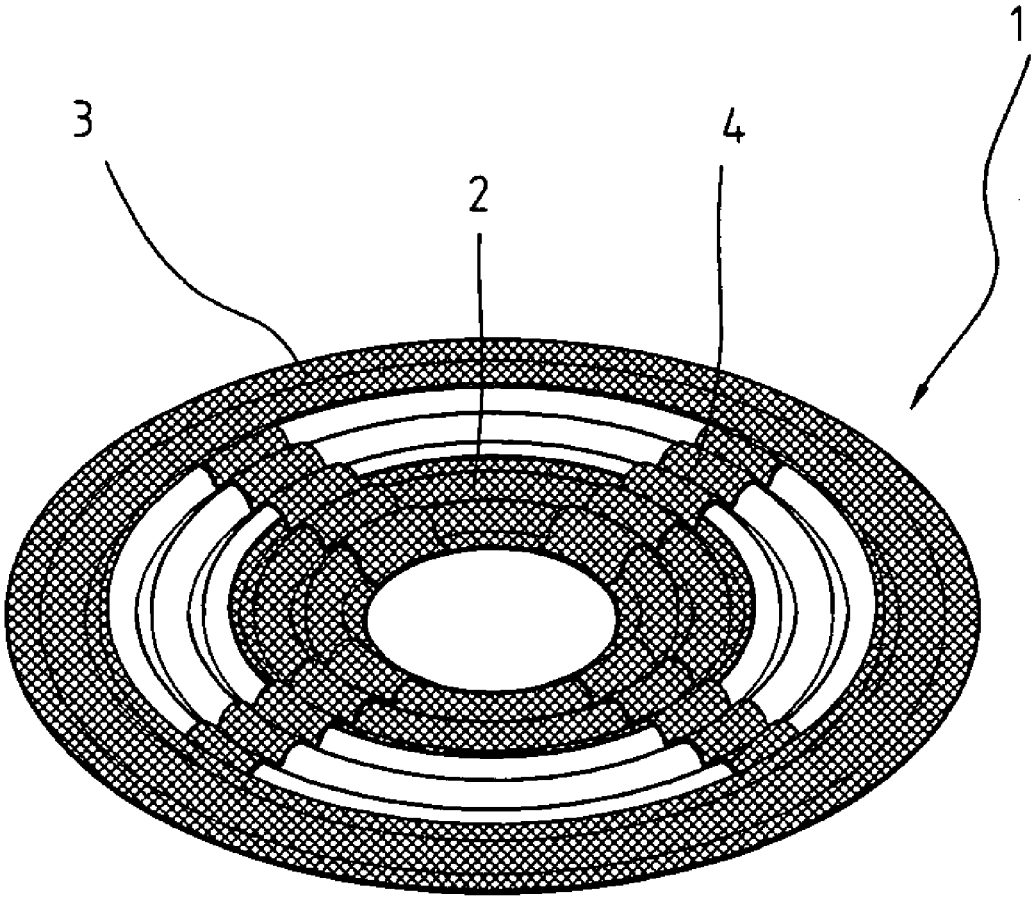
FIG. 7 is a perspective view of a damper in accordance with a seventh embodiment of the present invention, showing that a smaller annular reinforcing piece and a larger annular reinforcing piece are attached to a surface of the damper near its inner and outer regions, respectively, and a plurality of straight reinforcing pieces are attached to the surface of the damper in its radial direction and preferably in equiangular distribution.
Figure 8:
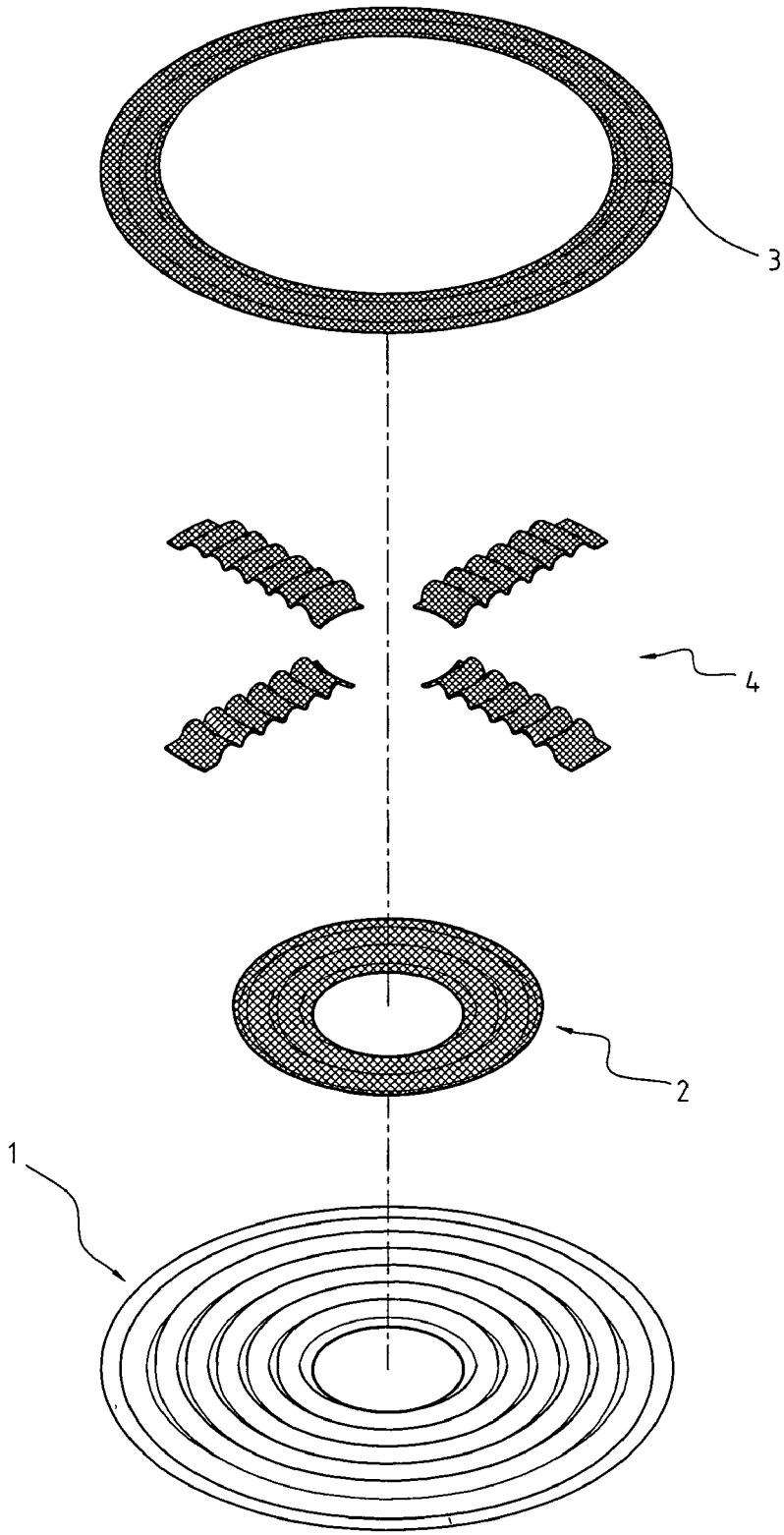
FIG. 8 is an exploded view of the damper in FIG. 7.
Figure 9:
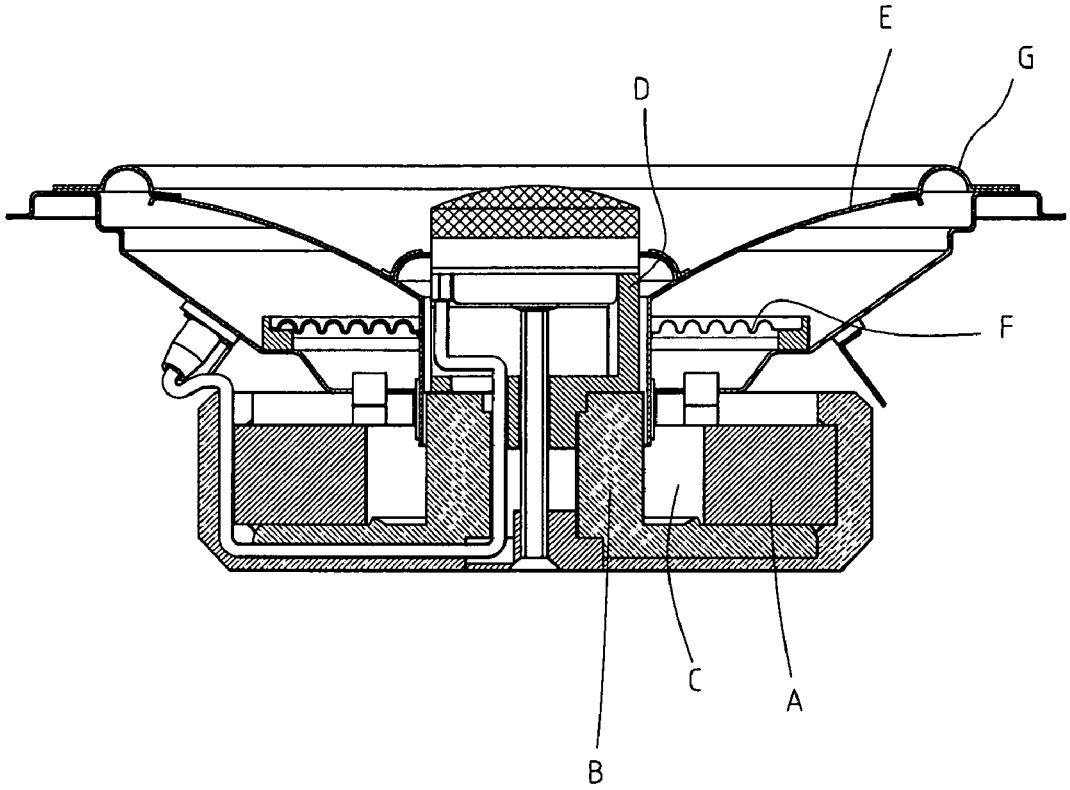
FIG. 9 is a cross sectional view of a dynamic speaker in accordance with a prior art.

Referring to FIGS. 7 and 8, a damper 1 in accordance with a seventh embodiment of the present invention has a corrugated surface, and an smaller annular reinforcing piece 2 and a larger annular reinforcing piece 3 are attached to the surface of the damper 1 near its inner and outer regions, respectively. And a plurality of straight reinforcing pieces 4 are attached to the surface of the damper 1 in its radial direction and preferably in equiangular distribution. The two annular reinforcing pieces 2, 3 and the straight reinforcing pieces 4 have a corrugated surface matching with the corrugated surface of the damper 1, thereby obtaining their tight attachment with each other.

The reinforcing piece may be made from, for example, cloth, plastics, rubber or silicone. In the case of cloth, the woven direction of the reinforcing piece must be different from that of the damper to obtain a better structural strength of the damper after it is attached with the damper.

In order to improve production efficiency, the unshaped damper and the unshaped reinforcing pieces 2, 3, 4 are first coated by adhesive, and then put together into a mold to attach them with each other while shaping the damper, thereby simplifying its manufacturing process.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A damper structure for a speaker, capable of preventing irregular vibrations and the improvements comprising: the damper having one or more elastic reinforcing pieces attached with a corrugated surface of the damper, wherein the reinforcement pieces comprise: an annular strip reinforcing piece having a corrugated surface corresponding to and attached to the corrugated surface of the damper near its inner region; and a plurality of straight strip reinforcement pieces having a corrugated surface corresponding to and attached to the corrugated surface of the damper in its radial direction and preferably in equiangular distribution.

2. The damper structure according to claim 1, wherein the reinforcement pieces comprise:

an annular strip reinforcing piece having a corrugated surface corresponding to and attached to the corrugated surface of the damper near its inner region; and an annular strip reinforcing piece having a corrugated surface corresponding to and attached to the corrugated surface of the damper near its outer region.

3. The damper structure according to claim 1, wherein the reinforcement pieces comprise:

an annular strip reinforcing piece having a corrugated surface corresponding to and attached to the corrugated surface of the damper near its inner region;

an annular strip reinforcing piece having a corrugated surface corresponding to and attached to the corrugated surface of the damper near its outer region; and a plurality of straight strip reinforcement pieces having a corrugated surface corresponding to and attached to the corrugated surface of the damper in its radial direction and preferably in equiangular distribution.

4. The damper structure according to claim 1, wherein the reinforcement pieces are attached with the corrugated surface of the damper by adhesive.

5. The damper structure according to claim 1, wherein the reinforcement pieces are of cloth, the woven direction of which is different from that of the damper.

6. The damper structure according to claim 1, wherein the reinforcement pieces are of plastics.

7. The damper structure according to claim 1, wherein the reinforcement pieces are of rubber.

8. The damper structure according to claim 1, wherein the reinforcement pieces are of silicone.

* * * * *